United States Patent [19]

Mortoly

[11] 4,062,320

[45] Dec. 13, 1977

[54] WORK SUPPORTING MEMBERS FOR GLUE APPLYING MACHINES

[75] Inventor: John L. Mortoly, Poughkeepsie, N.Y.

[73] Assignee: James L. Taylor Mfg. Co., Poughkeepsie, N.Y.

[21] Appl. No.: 723,755

[22] Filed: Sept. 16, 1976

[51] Int. Cl.[2] ..... B05C 1/02; B05C 13/00

[52] U.S. Cl. ..... 118/239

[58] Field of Search ..... 118/239, 324, 500; 198/850, 851, 698, 699

[56] References Cited

U.S. PATENT DOCUMENTS

| | | | |
|---|---|---|---|
| 1,917,767 | 7/1933 | Larson | 118/324 X |
| 2,169,772 | 8/1939 | Schweitzer | 118/324 X |
| 2,461,150 | 2/1949 | Flynn et al. | 198/698 X |
| 2,588,874 | 3/1952 | Quick | 118/1 |
| 2,987,169 | 6/1961 | Hinchcliffe | 198/699 |
| 3,703,382 | 11/1972 | Harkey | 118/16 X |

*Primary Examiner*—John P. McIntosh

*Attorney, Agent, or Firm*—William V. Ebs

[57] ABSTRACT

A glue applying machine is provided with work supporting members which are generally triangular in cross-section, are secured to endless driven belts and are disposed to contact work pieces at the apex of the triangular shape.

2 Claims, 4 Drawing Figures

WORK SUPPORTING MEMBERS FOR GLUE APPLYING MACHINES

BACKGROUND OF THE INVENTION

1. Field of the Invention

The invention relates to glue applying machines and is particularly directed to work supporting members for use in such machines.

2. Description of the Prior Art

It is customary in glue applying machines to provide right angle cross-members between endless driven belts and to secure the cross-members to the belts in positions such that they are disposed to support work pieces on upright legs of the members. It has been a disadvantage of such constructions that glue quickly accumulated on the work supporting members and was difficult to remove so that frequent and long shut downs of the glue machines proved necessary.

SUMMARY OF THE INVENTION

In accordance with the invention, a glue applying machine is provided with work supporting members which are so configured and are of a material such that glue does not readily adhere thereto, and insofar as glue does adhere can readily be removed from the members. The members are generally triangular in cross-section or are otherwise generally tubular in form, are secured to endless driven belts in positions such as to support work pieces on apex portions of the members and are of stainless steel or are steel coated as with "Chrome" providing a smooth metal outer surface to which glue does not readily adhere.

DESCRIPTION OF THE PREFERRED EMBODIMENT

Figure 1:
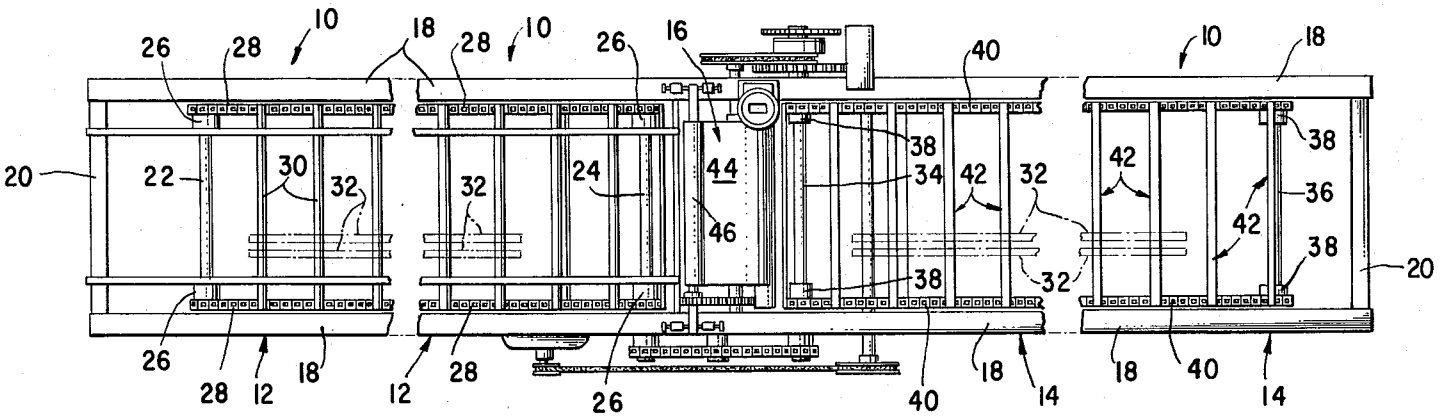
FIG. 1 is a plan view of a glue applying machine including work supporting members according to the invention.
Figure 2:
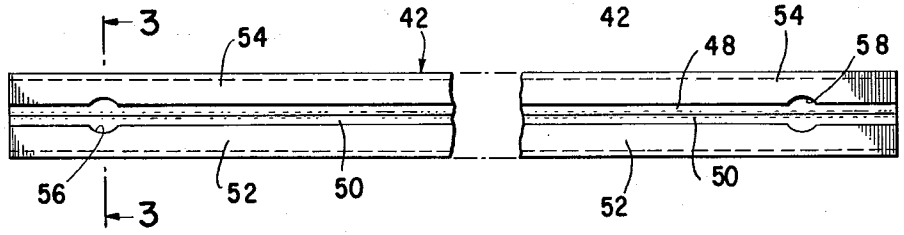
FIG. 2 is an enlarged bottom plan view showing the underside of a work supporting member according to the invention.

Referring to the drawings, reference character 10 designates a portion of a glue applying machine of the kind shown and described in U.S. Pat. No. 2,588,874 issued Mar. 11, 1952 to Lloyd Quick. As disclosed in the said patent, such machine includes a feed or loading portion 12, a take-off or unloading portion 14, and a glue-applying unit 16 interposed between them.

The machine includes a frame having side bars 18 which are connected by cross-bars 20, and the feed or loading portion 12 includes two shafts 22 and 24 journaled in the frame and each carrying a pair of sprockets 26 over which pass endless chains 28. Cross-members 30 are secured to and extend transversely between the endless chains 28 to support work pieces as boards 32 to be coated on their edges with glue at the glue applying unit 16.

The take-off or unloading portion of the machine similarly includes shafts 34 and 36 journaled in the frame and carrying sprockets 38 over which run endless chains 40 that carry work supporting cross members 42. Preferably the feed and take-off portions of the machine are so arranged that the upper edges of the work supporting members 30 and 42 are in substantially the same plane.

The glue-applying unit 16 includes a glue applicator roll 44 also journaled in the side bars 18 of the frame, a glue pot (not shown) under the applicator roll, and a doctor roll 46. The glue applicator roll 44 dips into the glue in the pot so that the periphery of the roll picks up some of the glue as the roll rotates, and the doctor roll 46 controls the thickness of the film or layer of glue on the roll 44.

In normal operation of the machine, the feed portion 12, take-off portion 14 and periphery of glue applicator roll 44 are all driven at the same speed and in the same direction so as to carry work pieces such as the boards 32 placed on the feed portion of the machine into contact with and over the glue applying roll and then over the take-away portion which carries the boards to a discharge location as for example at the conveyor of the glue press as shown in the said U.S. Pat. No. 2,588,874.

Figure 3:
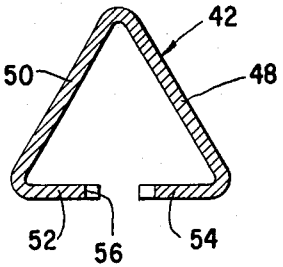
FIG. 3 is enlarged cross sectional view taken on the plane of the line 3—3 of FIG. 2.
Figure 4:
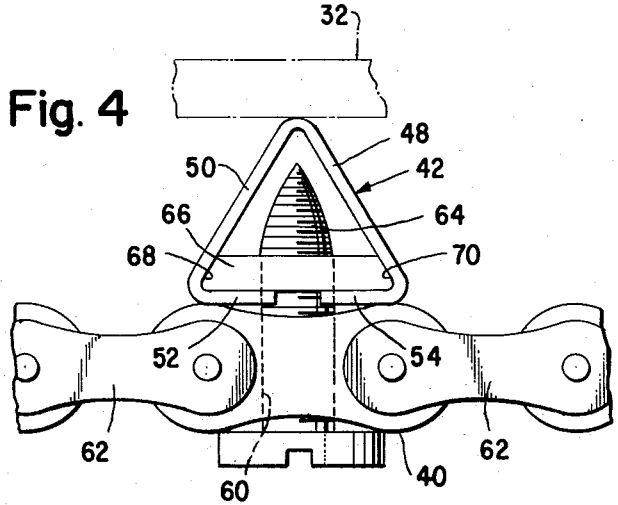
FIG. 4 is an end elevational view illustrating the method of attaching the work supporting members of FIG. 2 and 3 to an endless driven chain of the glue machine.

The cross-members 42 are generally tubular. As shown such cross members are generally triangular in cross-section (see FIG. 3) and are so secured to the endless chains 40 that the apex portions of the members contact the work pieces. Preferably the cross-members 42 are of stainless steel since stainless steel members while not prohibitively costly provide smooth surfaces to which glue does not readily adhere and from which any accumulated glue can be easily removed. The steep sides 48 and 50 of the triangular form of the cross-members also serve to hinder the accumulation of glue thereon and the triangular shape is particularly suited to providing the requisite support of and minimal contact with work pieces carried by the cross-members.

The cross-members 42 while generally tubular in form may be discontinuous as at 50 on the underside between flange portions 52 and 54 as shown. In any event the underside is provided with openings such as 56 and 58 which align with spaces 60 between links 62 of endless chains 40. The cross-members 42 are secured to the endless chains 28 by screws 64 extending through the openings in the underside of the members 42 and into nuts 66 inserted into the members through the ends thereof. The side surfaces 68 and 70 of the nuts 66 match inside surfaces of the cross-members 42 and prevent turning of the nuts when screws 64 are tightened so that no special tool is required to hold the nuts as the cross-members are secured to the endless chains.

Only the take-off portion 14 of the glue machine of FIG. 1 has been described as having tubular work supporting cross-members which are preferably triangular in cross-section and are of stainless steel. The cross-members 30 on feed or loading portion 12 of the machine may be similarly constructed. However, since the cross-members 30 support work pieces to which glue has not yet been applied and glue does not accumulate on these parts, they may be simple right angled cross bars as disclosed in the aforesaid U.S. Pat. No. 2,588,874.

The invention has been described herein in its preferred form, however it is to understood that the invention is not limited to the particular form disclosed, that the words used are words of description only and not of limitation, and that various changes and modifications may be made in the disclosed structures without departing from the spirit and scope of the invention as set forth in the annexed claims.

I claim:

1. In a glue machine, the combination comprising an applicator for applying glue to work pieces, means for moving the work pieces to which glue has been applied, the work moving means including a pair of endless driven chains and work supporting members extending between and secured to the chains, the work supporting members being generally tubular in configuration and disposed for line contact with the work pieces, said work supporting members being circumferentially discontinuous between inwardly turned flange portions defining an open channel on the underside, and fastening means extending through links of the chains and channels of the work supporting members for securing the work supporting members to the chains, the fastening means including fastening members in engagement with inside surfaces of the tubular supporting members and cooperating fastening members in engagement with links of the chains.

2. The combination of claim 1 wherein the tubular work supporting members are generally triangular in cross section and the fastening members in engagement with the work supporting members have side surfaces conforming to the inside surfaces of opposite side walls of the work supporting members whereby such fastening members are prevented from turning in the work supporting members.

* * * * *